United States Patent [19]

Reece et al.

[11] Patent Number: 4,676,482

[45] Date of Patent: Jun. 30, 1987

[54] VALVE SEAT INSERT

[75] Inventors: Marvin P. Reece, Dana Point, Calif.; Peter J. Boote, Oakham, England

[73] Assignee: Rexnord Inc., Brookfield, Wis.

[21] Appl. No.: 856,269

[22] Filed: Apr. 28, 1986

[51] Int. Cl.[4] ..... F01L 3/00

[52] U.S. Cl. ..... 251/365; 251/362; 123/188 S

[58] Field of Search ..... 251/359, 362, 365; 123/188 S

[56] References Cited

U.S. PATENT DOCUMENTS

| | | | |
|---|---|---|---|
| 1,328,362 | 1/1920 | Bordeaux | 29/214 |
| 1,331,305 | 2/1920 | Wilkinson, Jr. | 29/214 |
| 1,560,235 | 11/1925 | Hinsch | 123/188 R |
| 1,720,486 | 7/1929 | Leipert | 29/156.7 A |
| 1,754,720 | 4/1930 | Leipert | 251/365 |
| 2,007,543 | 7/1935 | Meeker | 123/188 S |
| 2,017,154 | 10/1935 | Larkin | 123/188 S |
| 2,035,165 | 3/1936 | Jardine | 123/188 S |
| 2,369,025 | 2/1945 | Cummings | 123/188 S |
| 2,406,963 | 9/1946 | Norton | 123/188 S |
| 2,424,738 | 7/1947 | Bronander | 123/188 S |
| 2,429,778 | 10/1947 | Stancliff | 251/167 |
| 2,517,114 | 8/1950 | Karcher et al. | 123/188 S |
| 2,665,675 | 1/1954 | Sheppard | 123/188 S |
| 2,672,856 | 3/1954 | Wagner | 123/188 S |
| 2,688,183 | 9/1954 | Oberley et al. | 29/214 |
| 2,923,284 | 2/1960 | Sullivan | 123/188 S |
| 2,985,424 | 5/1961 | Anderson et al. | 251/332 |
| 3,028,850 | 4/1962 | Gleeson | 123/188 S |
| 3,046,965 | 7/1962 | Kauffmann et al. | 123/188 S |
| 3,115,127 | 12/1963 | Spencer et al. | 123/41.82 |
| 3,165,101 | 1/1965 | Vargyai | 123/188 S |
| 3,260,252 | 7/1966 | Morris | 123/188 S |
| 3,285,235 | 11/1966 | Ueberschaer | 123/188 S |
| 3,387,353 | 6/1968 | Romero | 29/213 |
| 3,388,450 | 6/1968 | Forsman | 29/213 |
| 3,487,823 | 1/1970 | Tarter et al. | 123/193 |
| 3,822,680 | 7/1974 | Schowalter | 123/41.16 |
| 3,868,953 | 3/1975 | Roll | 123/188 S |
| 3,898,726 | 8/1975 | Godart et al. | 29/213 |
| 4,026,001 | 5/1977 | Jones | 29/252 |
| 4,106,466 | 8/1978 | Goloff | 123/188 S |
| 4,108,132 | 8/1978 | Hayashi | 123/188 S |
| 4,236,495 | 12/1980 | Rosan, Jr. | 123/188 S |

FOREIGN PATENT DOCUMENTS

| | | |
|---|---|---|
| 1091825 | 10/1960 | Fed. Rep. of Germany . |
| 2921797 | 12/1980 | Fed. Rep. of Germany . |

*Primary Examiner*—A. Michael Chambers

[57] ABSTRACT

The present invention provides a valve seat insert (10) design which has improved heat transfer properties and thus results in improved engine performance. The insert (10) includes a pilot flange (12), a locking flange (15), and an annular groove (20) defined by the two flanges (12, 15). The diameter (D3) of the annular groove (20) is less than the pilot flange diameter (D1). The pilot flange diameter (D1) is less than the diameter (D2) of the locking flange (15). The height (H1) for the annular groove (20) is less than the height (H2) for the locking flange (15). Accordingly, when the invention is installed, engine head material which is displaced by the locking flange (15) fills the annular groove area and places the exterior surface (13) of the pilot flange (12) under a compressive load. This construction eliminates the occurrence of air gaps along the pilot flange exterior surface (—) and thus provides for an optimum transfer of heat in the engine cylinder head.

3 Claims, 6 Drawing Figures

VALVE SEAT INSERT

TECHNICAL FIELD

The present invention relates to valve seat inserts and in particular to valve seat inserts used in applications where optimum heat transfer is required, e.g. in high performance internal combustion engines.

BACKGROUND

Standard prior art valve seat inserts are press-fitted into and retained in an engine cylinder head by an interference fit of the insert with an opening in the head. A typical length for such an insert is at least 0.300 inches or 7.6 mm. For early industry needs such inserts provided an adequate performance. A recurring problem however is encountered by the industry for such inserts. That problem is how to reliably secure or lock the insert into the engine cylinder head so that it does not become dislodged during the operation of the engine.

An answer to that problem was developed by, and U.S. Pat. No. 4,236,495 issued to, Jose Rosan Jr. for a "Self-Locking Valve Seat Insert," on Dec. 2, 1980. What is shown and described in the patent to Rosan is a valve seat insert design which uses a serrated locking flange for achieving a reliable locking of the insert in the engine cylinder head. Such a solution has been widely received in the industry.

While the standard interference fit valve seat inserts and the Rosan self-locking valve seat insert provided early advances in the state of the art of the industry, such inserts have not necessarily kept pace with the engines in which they must be used. Specifically, as the state of the art for engines has steadily progressed, e.g. higher performance standards and the use of exotic materials for such engines, the transfer of heat in such engines has become a critical performance component. No longer is it merely satisfactory that a valve seat insert stay securely locked in the engine cylinder head, but such an insert must now contribute to achieving the optimum transfer of heat required by the new engine designs.

Hence the need for further development in the state of the art for valve seat inserts. It is believed the present invention advances the state of the art beyond what is presently known, to what is now needed to answer the new performance requirements of the next generation of internal combustion engine designs.

SUMMARY

The present invention is an improved valve seat insert designed for installation in a prepared opening in an internal combustion engine cylinder head. By virtue of its specific design features the present invention achieves an elimination of air gaps or voids which in the past have adversely affected the transfer of heat and consequently the performance of the engine itself.

Specifically, the present invention envisions an insert which has a pilot flange, a locking flange and an annular groove defined between the two flanges. The diameter of the annular groove is less than the diameter of the pilot-flange; with the pilot flange diameter being less than the locking flange diameter. In combination with these specific diameter relationships, the height of the annular groove is less than the locking flange height. These specific diameter and height relationships result in an insert which when installed causes the adjacent material of the cylinder head to be displaced by the locking flange such that the annular groove of the insert is filled by the displaced material and further, the pilot flange exterior surface in contact with the cylinder head material, is placed under compression by the displaced material. Accordingly such a construction for the valve seat insert virtually eliminates the occurrence of air gaps between the installed insert and the engine cylinder head and as a result, an optimum transfer of heat may be accomplished across the insert.

It has been discovered also that a total height range for the insert of the present invention is preferably not less than 0.110 inches 2.75 mm nor greater than 0.180 inches or 4.57 mm.

Essentially, the present invention may be summarized as providing the industry with an insert designed such that the maximum possible air gap volume, which may occur along the pilot flange of the installed insert, is always less than the difference between the volume of the shoulder portion of the locking flange and the volume of the annular groove. The annular groove is that space defined between the shoulder portion of the locking flange and the upper surface of the pilot flange.

These and other features and advantages of the present invention will be described in further detail in the description of a preferred embodiment which follows.

DETAILED DESCRIPTION OF THE PREFERRED EMBODIMENT

Figure 1:
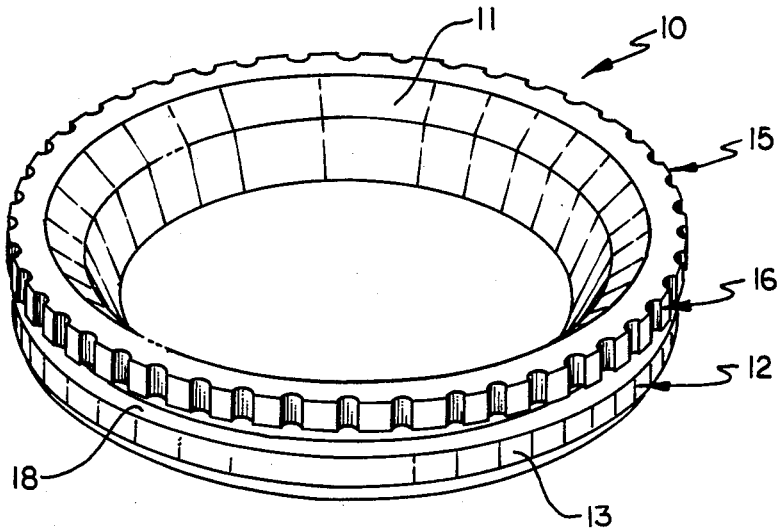
FIG. 1 is a view in perspective of a preferred embodiment of the present invention.
Figure 2:
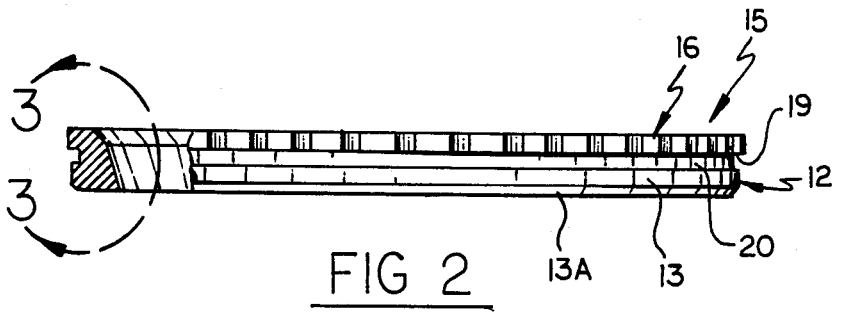
FIG. 2 is a side elevational view shown partly in cross-section of the preferred embodiment shown in FIG. 1.

Turning first to FIGS. 1 and 2 a preferred embodiment will be described for the present invention. The valve seat insert shown in FIGS. 1 and 2 has a body 10 with three distinct portions, i.e. a first end, a second end, and an intermediate portion defined by the two ends. The insert body itself is ring-shaped in that a bore 11 extends through the body from one end to the other. The bore 11 of an installed insert provides a passageway within the cylinder head.

The first end of the body 10 defines a pilot flange 12. This end of the body 10 first enters the prepared opening in the cylinder head as the insert is being installed. As such, the pilot flange preferably has a smooth exterior surface 13 and a beveled or leading surface 13A for facilitating entry of the insert into a prepared opening.

The second end of the body 10 defines a locking flange 15. In a preferred embodiment the locking flange 15 provides a mechanism for preventing rotation of the insert body after it has been installed in the cylinder head. In the preferred embodiment this mechanism is provided by a series of individual serrations or notches 16 arranged along the circumference of the locking flange outer diameter. The use of serrations for the anti-rotation feature of the invention is comparable to that which is taught in the earlier Rosan patent discussed in the BACKGROUND above.

The two flanges 12, 15 are integrally connected and thus define, between an upper surface 18 of the pilot flange 12 and a lower surface 19 of the locking flange 15, an annular groove 20.

Figure 3:
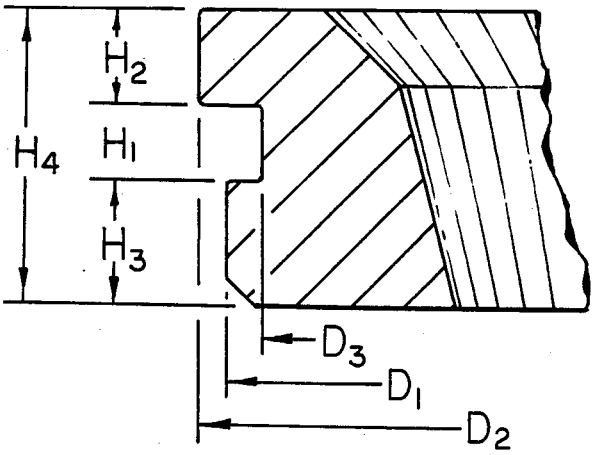
FIG. 3 is an enlarged view of a portion of the preferred embodiment shown in FIG. 2.

With reference now to FIG. 3, further details of the construction of any embodiment of the present invention will be described. In FIG. 3 the various heights and diameters for the insert body are identified. In any given embodiment for the present invention the height and diameter relationships will be as follows: The pilot flange 12 has an outer diameter D1 which is less than the outer diameter D2 of the locking flange 15. The outer diameter D3 of the annular groove 20 is less than the diameter D1 of the pilot flange 12. The height H1 of the annular groove 20 is less than the height H2 of the locking flange 15. H3 designates the height of the pilot flange 15.

For the present invention the total height H4 for the insert is significantly less than the standard prior art insert height of 0.300 inches or 7.62 mm. It has been discovered that in a preferred embodiment the total height H4 for the insert body should be no greater than 0.180 inches or 4.57 mm but no less than 0.110 inches or 2.75 mm.

For illustrative purposes only in order to better appreciate the present invention, an example of one set of height and diameter relationships for a preferred embodiment have been developed as follows: D1 equals 1.684 inches or 42.70 mm; D2 equals 1.714 inches or 43.50 mm; and D3 equals 1.654 inches or 42.00 mm. H1 is equal to 0.040 inches or 1.02 mm; H2 equals 0.050 inches or 1.27 mm; H3 equals 0.070 inches or 1.77 mm; and H4 equals 0.160 inches or 4.06 mm. In comparison with any prior art valve seat insert the present invention is a "short" insert.

Figure 4:
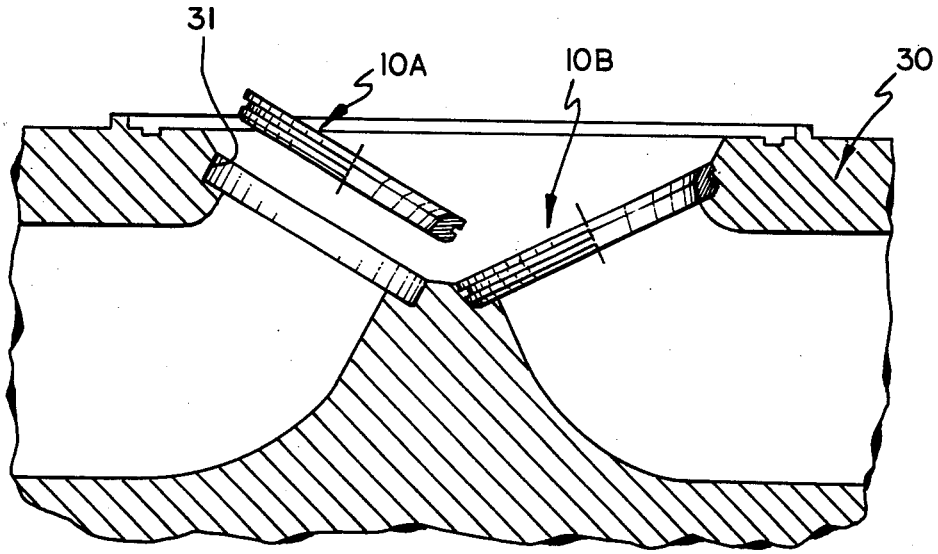
FIG. 4 is a side elevational, cross-sectional view of an engine cylinder head illustrating one possible installation and application for the preferred embodiment of the present invention.
Figure 5:
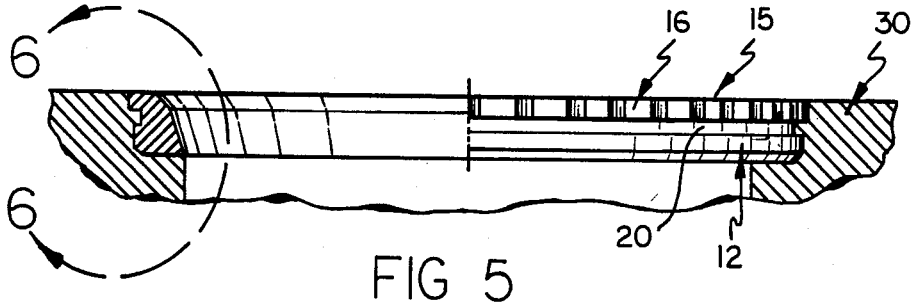
FIG. 5 is a view in cross-section showing the preferred embodiment as installed in the engine cylinder head shown in FIG. 4.
Figure 6:
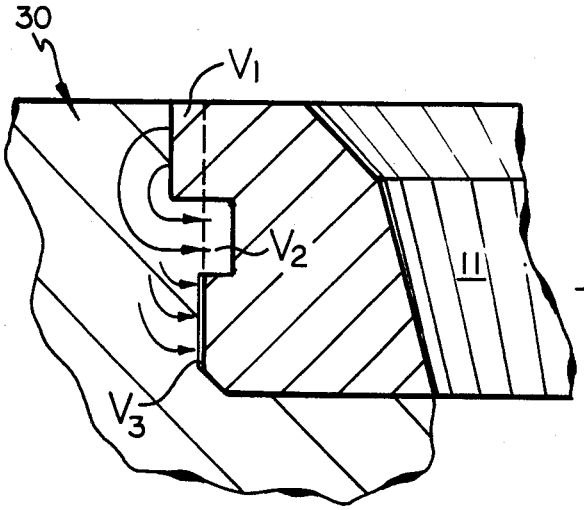
FIG. 6 is an enlarged view of a portion of what is shown in FIG. 5 illustrating schematically the forces and directional movement of the displaced material of the cylinder head with respect to the insert of the preferred embodiment.

Turning now to FIGS. 4–6 the advantages of the present invention over the prior art may be further explained. In FIG. 4 an engine cylinder head 30 of conventional design is illustrated. A valve seat insert 10A and a valve seat insert 10B, both constructed in accordance with the design for the preferred embodiment described above, are shown. A prepared opening 31 of a pre-determined diameter may be seen as it would appear just prior to the installation of the valve seat insert 10A, which in this instance represents an exhaust valve seat insert. An intake valve seat insert 10B is shown already installed. The valve seat inserts of the present invention are installed in a conventional manner, i.e. by using a hydraulic press to press the insert into the prepared opening 31. It should be noted that in any embodiment for the present invention the diameter D1 for the pilot flange 12 should be substantially equal, and not greater then, the diameter of the prepared opening 31.

In FIG. 5 a view of the installed insert 10B of the preferred embodiment is shown partially in cross-section and partially in plan elevation for the understanding of the reader.

A portion of what is shown in FIG. 5 has been greatly enlarged in FIG. 6 to illustrate the particular advantages of the present invention over the known prior art. In FIG. 6 arrows have been drawn to indicate the directional flow and the resulting compressive forces of the material of the cylinder head opening 31 which is displaced upon installation of the invention. Also shown schematically are three volume relationships: V1, V2, and V3. V1 represents the volume of the shoulder portion of the locking flange 15. V2 represents the volume of the annular groove space which is defined as being located directly between the lower surface 19 of the locking flange 15 and the upper surface 18 of the pilot flange 12. V3 is the maximum permissible volume for any air gaps which may occur along the exterior surface 13 of the pilot flange.

From a study of FIG. 6 in combination with what has been described in the foregoing paragraphs a key feature of the present invention may be variously described as follows: In a valve seat insert constructed in accordance with the teachings of the present invention and installed in a prepared opening, the material of the cylinder head, which is displaced by the locking flange, will completely fill the annular groove area of the insert and will place the pilot flange 12 along its exterior surface 13 under a compressive load. The combination of the overfilling of the annular groove area with a compressive force being exerted upon the pilot flange exterior surface 13 will virtually eliminate the occurrence of air gaps between the insert and the cylinder head. This result yields a valve seat insert which out performs all known prior art valve seat inserts in that the heat transfer is at an optimum compared with the prior art. This has significant consequences for the internal combustion engine industry in that with the possibility of improved heat transfer achieved by the present invention, the industry can expect and design for reduced valve temperatures. This permits a design flexibility with respect to choice of materials used in the manufacture of the engine heads, the valve seat inserts, and valves which has not been permitted by the designs of the prior art valve seat inserts. For example, the fact that the overall height of the present invention is significantly reduced compared to the prior art designs will allow placement of the water jacket closer to the most heat intensive areas of the engine. Because the present invention is able to dissipate more heat, manufacturers will have a greater range of materials to select from for the manufacture of the valve seat insert and related components. Accordingly cost and performance criteria can both be improved.

Another way to appreciate the present invention is to consider the volume relationships which result from the height and diameter relationships of the present invention. In the present invention V3, the volume of the maximum air gap along the pilot flange exterior surface 13, is eliminated. This is achieved because such a volume V3 is always less than the difference between the locking flange shoulder portion volume V1 and the volume V2 of the annular groove area. Thus when the "short" valve seat insert of the present invention is properly installed, i.e. fully pressed into the cylinder head, the maximum air gap volume (which might otherwise occur in the designs of the prior art valve seat inserts) is eliminated, thus assuring that no air gap exists at any installation, and thereby assuring optimum heat transfer and performance of the engine.

The scope of the invention is limited solely by the claims which follow.

What is claimed is:

1. A valve seat insert adapted for installation into a prepared opening having a given diameter in an engine cylinder head, said insert comprising:

a body having a predetermined height, a centrally located bore extending therethrough, a first end, and a second end opposite thereto;

said first end defining a pilot flange having a predetermined diameter, a predetermined height, and an exterior surface, said predetermined diameter being less than or equal to the diameter of the prepared opening in an engine cylinder head into which said insert is adapted for installation;

said second end defining a lock flange have a predetermined diameter and a predetermined height;

said first and second ends defining an annular groove therebetween, said annular groove having a predetermined height and a predetermined diameter;

said annular groove diameter being less than said pilot flange diameter, and said pilot flange diameter being less than said locking flange diameter, with said annular groove height being less than said locking flange height;

said predetermined heights and diameters being of relative sizes such that when said insert is installed in the prepared opening, material displaced by said locking flange fills said annular groove and places said pilot flange exterior surface under compression, thereby eliminating the occurrence of air gaps between said insert and the prepared opening in the engine cylinder head and providing an optimum transfer of heat between said insert and the engine cylinder head.

2. The valve seat insert of claim 1 wherein said body predetermined height is not less than 0.110 inches nor greater than 0.180 inches.

3. A valve seat insert adapted for installation into a prepared opening having a given diameter in an engine cylinder head, said insert comprising:

a body having a predetermined height of not less than 0.110 inches nor greater than 0.180 inches, a centrally located bore extending therethrough, a first end, and a second end opposite thereto;

said first end defining a pilot flange having a predetermined diameter, a predetermined height, and an exterior surface, said predetermined diameter being less than or equal to the diameter of the prepared opening in an engine cylinder head into which said insert is adapted for installation;

said second end defining a locking flange having a predetermined diameter and a predetermined height;

said first and second ends defining an annular groove therebetween, said annular groove having a predetermined height and a predetermined diameter;

said annular groove diameter being less than said pilot flange diameter, and said pilot flange diameter being less than said locking flange diameter, with said annular groove height being less than said locking flange height;

said predetermined height and diameters being of relative sizes such that when said insert is installed in the prepared opening, material displaced by said locking flange fills said annular groove and places said pilot flange exterior surface under compression, thereby eliminating the occurrence of air gaps between said insert and the prepared opening in the engine cylinder head and providing an optimum transfer of heat across said insert.

* * * * *